US006322053B1

(12) United States Patent
Baulier

(10) Patent No.: US 6,322,053 B1
(45) Date of Patent: Nov. 27, 2001

(54) BALANCING SYSTEM WITH A FORCE MULTIPLYING DEVICE

(75) Inventor: Dominique Baulier, Windsor (CA)

(73) Assignee: Valiant Machine & Tool Inc. (CA)

( * ) Notice: Subject to any disclaimer, the term of this patent is extended or adjusted under 35 U.S.C. 154(b) by 0 days.

(21) Appl. No.: 09/500,001

(22) Filed: Feb. 8, 2000

(51) Int. Cl.[7] ..... B66D 1/10; F21V 21/20

(52) U.S. Cl. ..... 254/360; 248/329; 362/401; 362/407

(58) Field of Search ..... 294/1.1, 67.2, 294/67.21; 254/360; 248/329; 362/401, 407

(56) References Cited

U.S. PATENT DOCUMENTS

| | | | | |
|---|---|---|---|---|
| 1,847,819 | * | 3/1932 | Davies | 294/67.2 |
| 2,514,307 | * | 7/1950 | Boyd | 294/67.21 |

FOREIGN PATENT DOCUMENTS

| | | | | |
|---|---|---|---|---|
| 1439125 | * | 4/1966 | (FR) | 294/67.21 |
| 1114348 | * | 5/1968 | (GB) | 294/67.21 |
| 1017647 | * | 5/1983 | (SU) | 294/67.21 |

* cited by examiner

*Primary Examiner*—Katherine A. Matecki
(74) *Attorney, Agent, or Firm*—Gifford, Krass, Groh, Sprinkle, Anderson & Citkowski, P.C.

(57) ABSTRACT

A force multiplying device is provided for use in conjunction with a balancing system for moving a load from an elevated position and to a predetermined lower position. The balancing system includes an extendable cable with a free end adapted to be secured to and exert an upward force on the load. The device includes a base which is secured to the load and a first lever pivotally secured at an intermediate point to the base about a generally horizontal axis. A fixed length flexible member has one end secured to a first end of the lever and a second end fixedly secured to a support position above the load. The length of the flexible member is such that the flexible member is in a fully extended position when the load is in the predetermined lower position. An elongated rocker arm has a first end in abutment with the base while the cable from the balancing system is secured to a second end of the rocker arm. A second end of the lever is pivotally secured to an intermediate point of the rocker arm so that, as the load nears the predetermined lower position, the first end of the lever pivots upwardly and simultaneously pivots the second end of the rocker end downwardly to thereby exert an increased downward stroke on the cable, and a corresponding upward force on the load. By construction, the length of each rocker and lever arms is such that the distance between the flexible member and the extendable cable is minimal. Furthermore, two systems like that can be symmetrically combined in such a way that the center of gravity of the load to be balanced remains in the same plane that the pair of flexible members and extendable cables, avoiding by that any swinging of the load during its entire stroke.

6 Claims, 4 Drawing Sheets

40
50
62
42
54
43
34
36
27

56
50
62
60
32
52
42
54
34
32
36

22
40

50
60
42
54
34
36
C.G.

BALANCING SYSTEM WITH A FORCE MULTIPLYING DEVICE

BACKGROUND OF THE INVENTION

I. Field of the Invention

The present invention relates generally to balancing systems of the type used in manufacturing facilities.

II. Description of the Prior Art

There are many manufacturing operations which require a heavy load to be lowered from an elevated position and to a lower position in preparation for a manufacturing and/or assembly operation. For example, in the manufacture of automobiles with hoods or rear hatchback doors, it is conventional to utilize a carrier to move the jig fixture centering the closure from an elevated position and to a predetermined lower position where the closure is secured to the vehicle body.

In order to provide a controlled movement of the jig fixture or other load from an elevated position and to a lower position, it has been previously known to utilize one or more pneumatic balancers. Such pneumatic balancers typically have an elongated cable with a free end secured to the load. As the load is lowered from an elevated and to a predetermined lower position, the pneumatic balancers exert an upward force on the load to thereby control and cushion the downward descent of the load as it is moved into its assembly position.

One disadvantage of these previously known balancing systems, however, is that certain vehicle components, such as vehicle hoods or hatchbacks, require a very heavy jig fixture, e.g. 1700 pounds, such that even a pair of pneumatic balancers is inadequate to provide to the jig fixture the vertical compliance required in its lower position to self-locate it onto the vehicle with a low level of constraint transmit to this vehicle. While it is possible to multiply by 2, 3 or 4 the number of these pneumatic balancers in order to increase the upward force exerted on the load during its descent, such pneumatic balancers are relatively expensive and are also subject to periodic maintenance and repair.

The previously known pneumatic balancers conventionally apply a substantially constant force, e.g. 100–300 pounds each, upwardly on the load, e.g. 1800 pounds during the entire descent of the load from its elevated and to its lower position. With two pneumatic balancers, only 30% of the weight can be compensated and the 70% remaining will be supported by the vehicle shell, causing not only some damage on the contact area, but generating also an inaccurate setting of the closure onto its opening.

SUMMARY OF THE PRESENT INVENTION

The present invention provides a force multiplying device for use in conjunction with a balancing system which overcomes all of the above-mentioned disadvantages of the previously known devices.

In brief, the device of the present invention comprises a base which is secured to the load so that the base moves in unison with the load. A lever is pivotally secured about an intermediate point on the lever to the base about a generally horizontal axis.

A fixed length flexible member, such as a chain, has one end secured to a first end of the lever and a second end fixedly secured to a support position above the load. The fixed length flexible member is dimensioned so that it is in a fully extended position when the load is in the predetermined lower position for the assembly and/or manufacturing operation.

An elongated rocker arm has a first end in abutment with the base while the cable from a balancer, such as a pneumatic balancer, is secured to a second end of the rocker arm. The second end of the lever, in turn, is pivotally secured to an intermediate point of the rocker arm. Consequently, as the load nears the predetermined lower position, the first end of the lever pivots upwardly due to the force exerted by the fixed length flexible member. In doing so, the lever simultaneously pivots the second end of the rocker arm, i.e. the end of the rocker arm connected to the balancer cable, downwardly to thereby exert an increased downward stroke on the cable and the corresponding increased upward force on the load. This increased upward force remains directly proportional to initial counterbalancing effort and can be accurately adjusted to exactly match the weight of the jig fixture as the load nears its final lower position.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
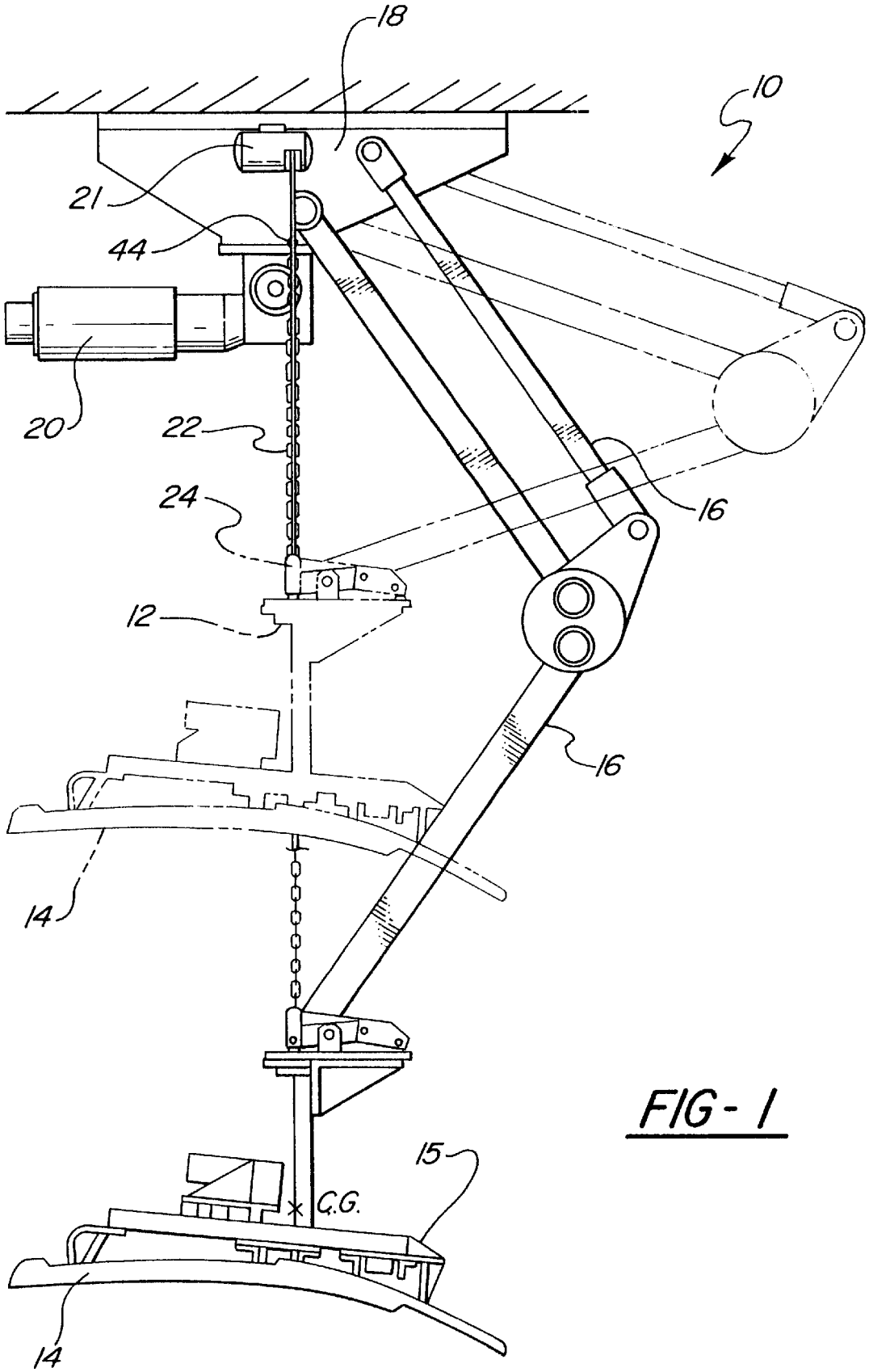
FIG. 1 is a side view illustrating a preferred embodiment of the present invention for use with a carrier of the type used in manufacturing operations.
Figure 2:
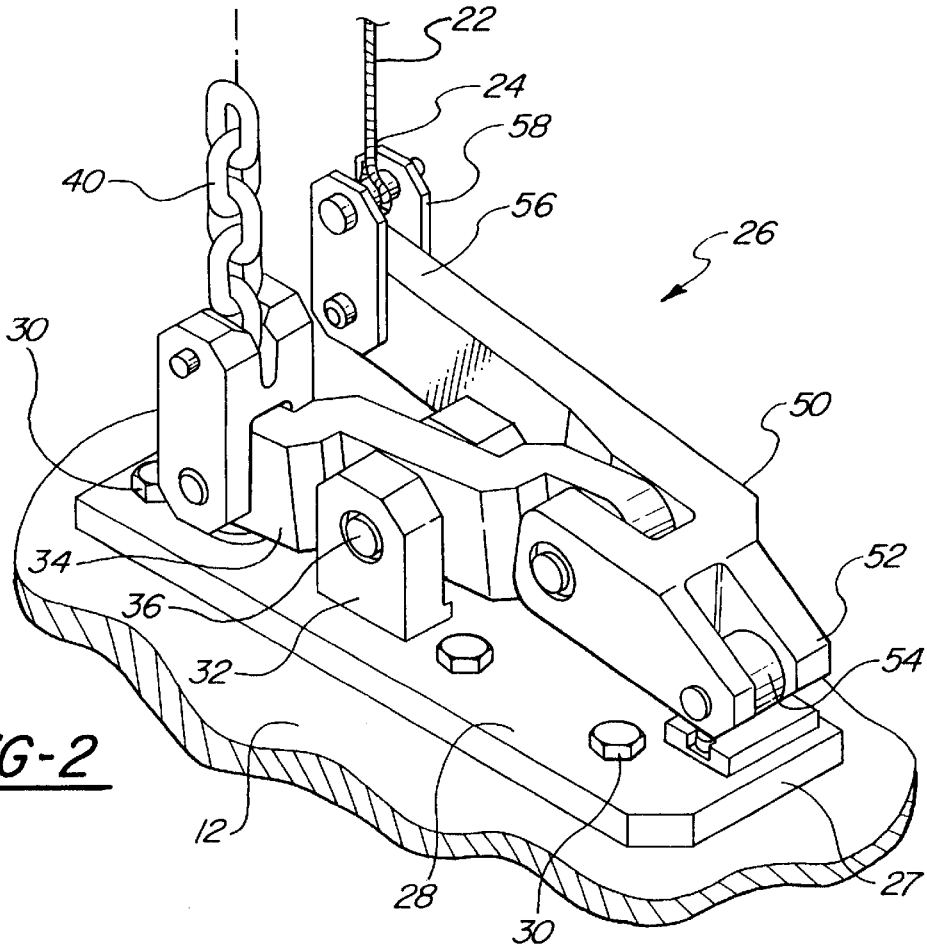
FIG. 2 is an elevational view illustrating the preferred embodiment of the present invention.
Figure 5:
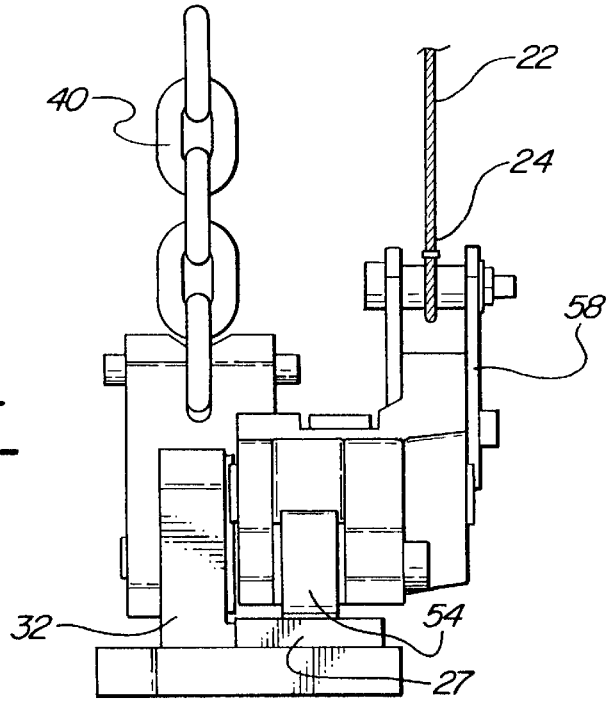
FIG. 5 is an end view illustrating the preferred embodiment of the present invention.

With reference first to FIG. 1, a typical carrier 10 for moving a load 12 between an upper position, illustrated in phantom line, and a predetermined lower position, illustrated in solid line, is shown. As illustrated in FIG. 1, the carrier 10 moves an automotive closure panel 14, such as a vehicle hatchback, between the upper and predetermined lower position. Furthermore, although the carrier 10 is illustrated as utilizing a plurality of scissor arms 16 actuated by an electric hoist 20 for movably securing the load 12 to an upper support 18, any conventional carrier system may be utilized without deviation from the spirit or scope of the invention. Furthermore, the load 12 includes not only the closure panel 14, but also a jig fixture 15 on the carrier 10 which releasably holds the closure panel 14.

Still referring to FIG. 1, a pneumatic balancer 21 includes an elongated and extensible cable 22 having a free end 24 secured to the load 12 in a fashion to be subsequently described in greater detail. Such pneumatic balancers 21 are conventional in construction and typically exert a constant upward force on the load 12, e.g. 300 pounds.

With reference now to FIGS. 2–5, a force multiplying device 26 according to the present invention is there shown and includes a base 28 secured to the top of the support 15 of the load 12 in any conventional fashion, such as by bolts 30. A pair of spaced axle supports 32 are secured to and extend upwardly from the plate 28.

Figure 3:
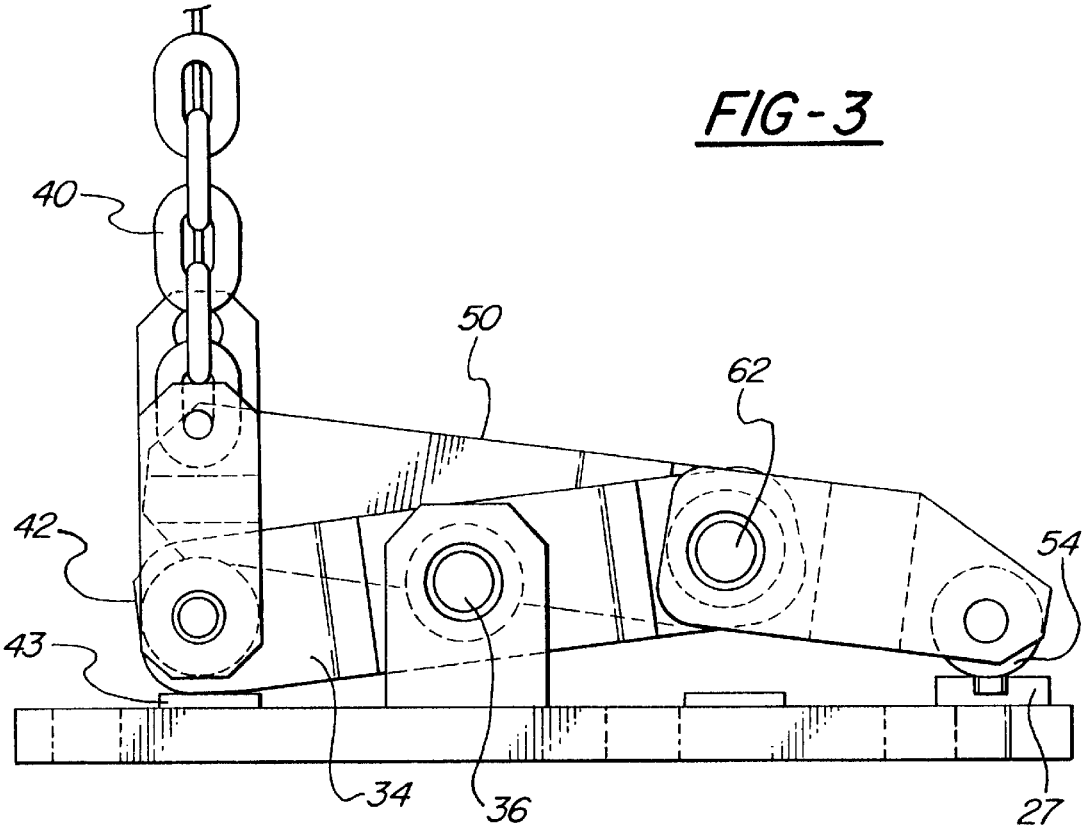
FIG. 3 is a side view illustrating the preferred embodiment of the present invention.
Figure 6:
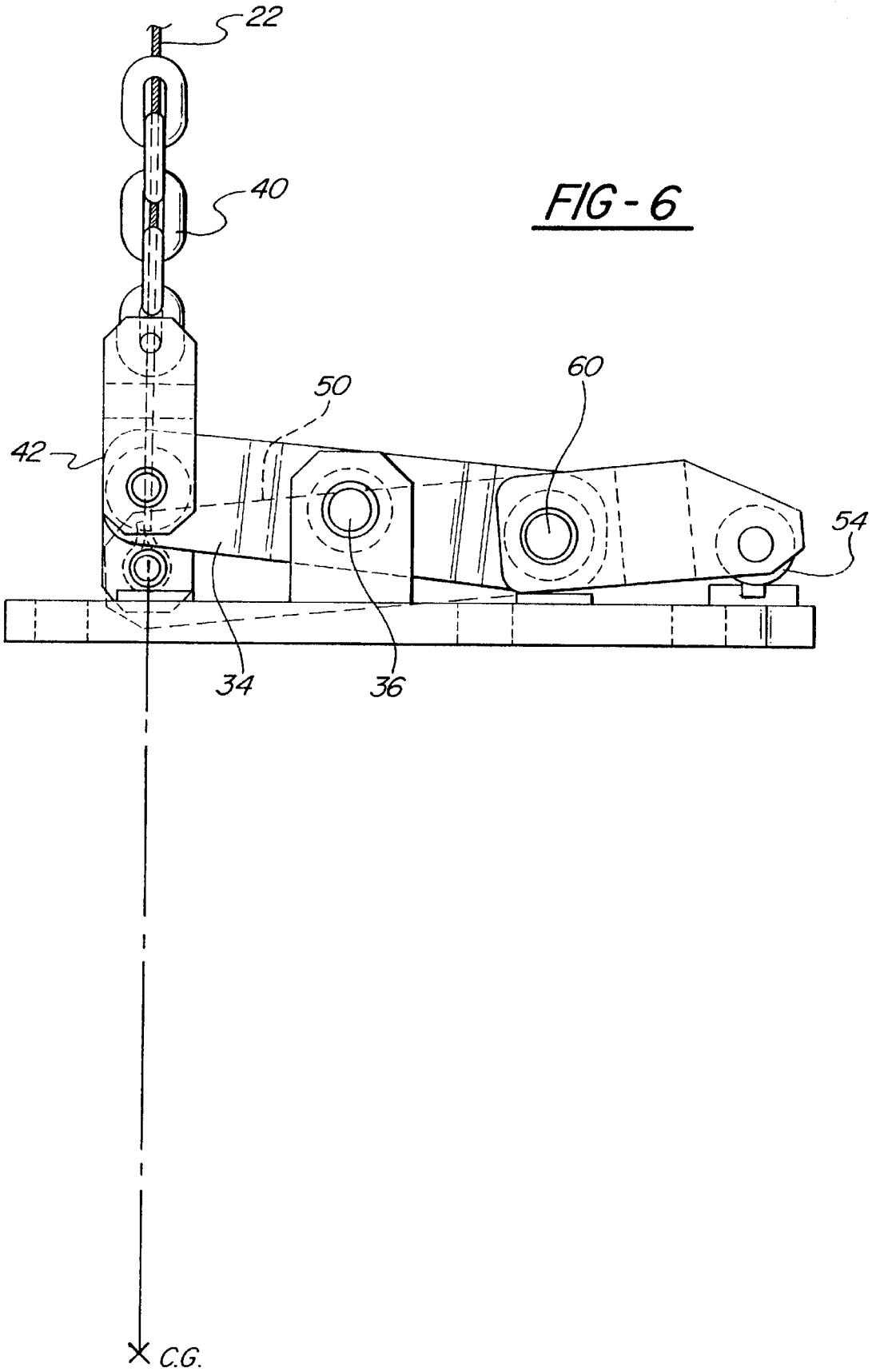
FIG. 6 is a view similar to FIG. 3, but illustrating the operation of the present invention.

An elongated lever 34 is pivotally secured by an axle 36 to the axle supports 32 so that the lever 34 is pivotal between a first position, illustrated in FIG. 3, and a second position, illustrated in FIG. 6. A fixed length flexible member 40, such as a chain or cable, is secured to a first end 42 of the lever 34 while the opposite end 44 (FIG. 1) of the fixed length flexible member is secured to the support 18. Furthermore, the length of the fixed length flexible member 40 is such that, when the load 14 is in its predetermined lower position, the fixed length flexible member 40 is fully extended and pivots the lever 34 close to the position shown in FIG. 6.

An elongated rocker arm 50 has a roller 54 rotatably mounted to a first end 52 of the rocker arm 50 and this roller 54 abuts against the plate 28 via a contact plate 27. The free end 24 of the cable 22 from the pneumatic balancer 20 is secured to a second end 56 of the rocker arm 50 in any conventional fashion, such as by a bracket 58.

Figure 4:
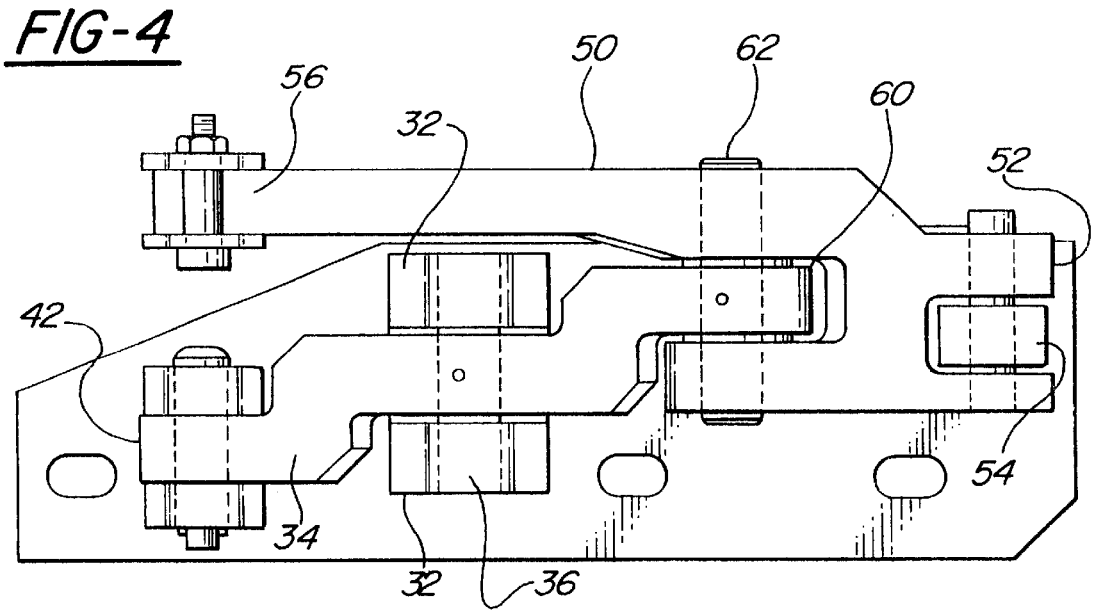
FIG. 4 is a top view illustrating the preferred embodiment of the present invention.

As best shown in FIGS. 3 and 4, a second end 60 of the lever 34 is pivotally connected by a pivot pin 62 to the rocker arm 50 at a point intermediate the ends 52 and 56 of the rocker arm 50. Furthermore, in the preferred embodiment of the invention, the distance between the pivot pin 62 and the end 56 of the rocker arm 50 is greater than the distance between the pivot pin 62 and the first end 52 of the rocker arm 50. By construction, and as shown in FIGS. 4 and 6, the length of each rocker 56 and lever 42 arms is such that the distance between the flexible member 40 and the extended cable 22 is minimal. Furthermore, two systems like that can be symmetrically combined in such a way that the center of gravity of the load 12 to be balanced remains perfectly in the same plane, as shown in FIG. 6, that the pair of flexible members 40, the pair of extended cables 22, and the pulley of the hoist 20 thereby avoiding any swinging of the load during its entire travel down to its lower position. Preferably, the distance between the pivot pin 62 and rocker arm end 56 is two times greater the distance between the pivot pin 62 and rocker arm end 52. In such a configuration, the counterbalancing force is multiplied by 4. Different ratios may be employed without deviation from the spirit or scope of the invention.

In operation, as the load 14 is initially lowered from its upper and towards its lower predetermined position, the upward force exerted by the balancer cable 22 on the rocker arm 50 maintains the force multiplying device 26 in the position illustrated in FIG. 3 in which the first end 42 of the lever 34 abuts against the plate 28 through a rubber damper 43.

As the load 12 nears its predetermined lower position, however, the fixed length flexible member 40 becomes fully extended thus pivoting the first end 42 of the lever upwardly ultimately close to the position shown in FIG. 6. Simultaneously, the pivotal action of the lever 34 pivots the second end 56 of the rocker arm 50 downwardly close to the position shown in FIG. 6. This action effectively increases the downward stroke on the balancer cable 22 and simultaneously increases the upward force exerted by the balancer 20 through the flexible member 40 on the load 14. This increased upward force on the load 12 to achieve even if needed a 100% counterbalancing just prior to the time the load 12 reaches its lower predetermined position.

From the foregoing, it can be seen that the present invention provides a force multiplying device which effectively permits to achieve even a full balancing of the load around a lower predetermined position. This characteristic allows a perfect vertical compliance of a jig fixture to accurately fit and self-locate onto the vehicle body with a minimum of constraint transmitted to it. Having described my invention, however, many modifications thereto will become apparent to those skilled in the art to which it pertains without deviation from the spirit of the invention as defined by the scope of the appended claims.

I claim:

1. A force multiplying device for use in conjunction with a balancing system for moving a load from an elevated position to a predetermined lower position, the balancing system having an extendable cable with a free end adapted to be secured to and exert an upward force on the load, said device comprising:

a base secured to the load, a lever pivotally secured at an intermediate point of said lever to said base about a horizontal axis, a fixed length flexible member having one end secured to a first end of said lever and a second end fixedly secured to a support positioned above the load, said fixed length flexible member being in a fully extended position when the load is in said predetermined lower position, an elongated rocker arm having a first end in abutment with said base, the cable being secured to a second end of the rocker arm, and means for pivotally securing a second end of said lever to an intermediate point of said rocker arm so that, as the load nears said predetermined lower position, said first end of said lever pivots upwardly and simultaneously pivots said second end of said rocker arm downwardly to thereby exert an increased downward stroke on the cable.

2. The invention as defined in claim 1 wherein said base is secured to the load in such a way that the center of gravity of the load is substantially vertically aligned with the flexible member.

3. The invention as defined in claim 1 wherein said fixed length flexible member comprises a chain.

4. The invention as defined in claim 1 wherein the distance between said second end of said rocker arm and said pivotal securing means is substantially two times the distance between said first end of said rocker arm and said pivotal securing means.

5. The invention as defined in claim 1 and comprising a roller secured to said first end of said rocker arm about a generally horizontal axis, said roller in abutment with said base.

6. The invention as defined in claim 1 wherein said fixed length flexible member comprises a cable.

* * * * *